US008659535B2

(12) United States Patent
Hwang et al.

(10) Patent No.: US 8,659,535 B2
(45) Date of Patent: Feb. 25, 2014

(54) ADAPTIVE SMOOTHING OF BACKLIGHT TO REDUCE FLICKER

(75) Inventors: Sarah Sunyoung Hwang, Sunnyvale, CA (US); Anthony Botzas, San Jose, CA (US)

(73) Assignee: Samsung Display Co., Ltd. (KR)

( * ) Notice: Subject to any disclaimer, the term of this patent is extended or adjusted under 35 U.S.C. 154(b) by 682 days.

(21) Appl. No.: 12/253,146

(22) Filed: Oct. 16, 2008

(65) Prior Publication Data

US 2009/0102783 A1 Apr. 23, 2009

Related U.S. Application Data

(60) Provisional application No. 60/981,355, filed on Oct. 19, 2007.

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 2005/0184952 | A1 | 8/2005 | Konno et al. | |
| 2007/0216636 | A1* | 9/2007 | Lo | 345/102 |
| 2008/0265865 | A1* | 10/2008 | Gurr | 324/71.1 |

FOREIGN PATENT DOCUMENTS

| | | |
|---|---|---|
| EP | 1482475 A1 | 12/2004 |
| JP | 2002-357810 | 12/2002 |
| JP | 2004-110050 | 4/2004 |
| JP | 2005-258403 | 9/2005 |
| JP | 2007-241236 | 9/2007 |

OTHER PUBLICATIONS

European Search Report dated Oct. 11, 2010.
Extended European Search Report EP 08 25 3221, dated Mar. 4, 2011, 9 pages.
European Patent Office First Examination Report, Application No. 08 253 221.9-2205, Jan. 13, 2012, 5 Pages.

* cited by examiner

*Primary Examiner* — Abbas Abdulselam
*Assistant Examiner* — Shawna Stepp Jones
(74) *Attorney, Agent, or Firm* — Innovation Counsel LLP

(57) ABSTRACT

A method and apparatus for adaptively controlling the backlight to reduce flicker in a display is provided. The apparatus includes a display, a backlight providing illumination for said display, a backlight control module for providing backlight control signals to said backlight, and an adaptive transition rate module. The module calculates an adaptive parameter based on a magnitude of change between backlight requirements for two frames, determining a smoothing function based on the adaptive parameter, and using said smoothing function to modify said backlight control signals. Techniques for adaptively controlling the illumination of the backlight according to the difference in the illumination levels of two different sets of image data are also disclosed.

12 Claims, 13 Drawing Sheets

ADAPTIVE SMOOTHING OF BACKLIGHT TO REDUCE FLICKER

CROSS-REFERENCE TO RELATED APPLICATION(S)

This patent application claims the benefit, under 35 USC 119, of U.S. Provisional Patent Application No. 60/981,355 filed on Oct. 19, 2007, the content of which is incorporated by reference herein.

Novel sub-pixel arrangements are disclosed for improving the cost/performance curves for image display devices in the following commonly owned United States Patents and patent applications including: (1) U.S. Pat. No. 6,903,754 ("the '754 Patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) U.S. Pat. No. 7,218,301 ("the '301 patent") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) U.S. Pat. No. 7,209,105 ("the '105 patent") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. Pat. No. 7,187,353 ("the '353 patent") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) U.S. Pat. No. 7,268,758 ("the '758 patent") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '404, and '277 published applications and the '353, '301, '105 and '758 patents are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and patent applications: (1) U.S. Pat. No. 7,123,277 ("the '277 patent") having application Ser. No. 10/051,612 and entitled "CONVERSION OF A SUB-PIXEL FORMAT DATA TO ANOTHER SUB-PIXEL DATA FORMAT," filed Jan. 16, 2002; (2) U.S. Pat. No. 7,221,381 ("the '381 patent") having application Ser. No. 10/150,355 entitled "METHODS AND SYSTEMS FOR SUB-PIXEL RENDERING WITH GAMMA ADJUSTMENT," filed May 17, 2002; (3) U.S. Pat. No. 7,184,066 ("the '066 patent") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) U.S. Pat. No. 7,167,186 ("the '186 patent") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 Patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '302, and '297 applications and the '277, '381, '066, '186 and '368 patents are hereby incorporated by reference herein in its entirety.

Improvements in gamut conversion and mapping are disclosed in commonly owned United States Patents and copending United States patent applications: (1) U.S. Pat. No. 6,980,219 ("the '219 Patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; (4) U.S. Pat. No. 7,176,935 ("the '935 patent") having application Ser. No. 10/690,716 and entitled "GAMUT CONVERSION SYSTEM AND METHODS" filed Oct. 21, 2003. Each of the aforementioned '341, and '352 applications and the '219 and '935 patents is hereby incorporated by reference herein in its entirety.

Additional advantages have been described in (1) U.S. Pat. No. 7,084,923 ("the '923 patent") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) U.S. Pat. No. 7,248,268 ("the '268 patent") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 2008/0170083; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 2008/0150958; (3) United States Patent Publication No. 2006/0244686 ("the '686 application") having application Ser. No. 11/278,675 and entitled "SYSTEMS AND METHODS FOR IMPLEMENTING IMPROVED GAMUT MAPPING ALGORITHMS" filed Apr. 4, 2006, and published as United States Patent Application Publication 2006/0244686 ("the '686 application"); (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 2008/0186325; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published as WO 2006/127555 (referred to below as the "Metamer Filtering application".) Each of these co-owned applications is also herein incorporated by reference in their entirety.

Additional improvements to, and embodiments of, display systems and methods of operation thereof are described in: (1) Patent Cooperation Treaty (PCT) Application No. PCT/US 06/40272, entitled "IMPROVED GAMUT MAPPING AND SUBPIXEL RENDERING SYSTEMS AND METHODS" filed Oct. 13, 2006, and published as WO 2007/047537; (2) Patent Cooperation Treaty (PCT) Application No. PCT/US 06/40269, entitled "IMPROVED MEMORY STRUCTURES FOR IMAGE PROCESSING" filed Oct. 13, 2006, and published as WO 2007/047534; (3) Patent Cooperation Treaty (PCT) Application No. PCT/US 07/79408, entitled "SYSTEMS AND METHODS FOR REDUCING DESATURATION OF IMAGES REDUCED ON HIGH BRIGHTNESS DISPLAYS" filed on Sep. 25, 2007 and published as WO 2008/039764; (4) Patent Cooperation Treaty (PCT) Application No. PCT/US 08/53450, entitled "SUBPIXEL PAYOUTS AND SUBPIXEL RENDERING METHODS FOR DIRECTIONAL DISPLAYS AND SYSTEMS" filed on Feb. 8, 2008 and published as WO 2008/100826; and (5) Patent Cooperation Treaty (PCT) Application No. PCT/US 07/68885, entitled "HIGH DYNAMIC CONTRAST SYSTEM HAVING MULTIPLE SEGMENTED BACKLIGHT" filed on May 14, 2007 and published as WO 2007/143340. Each of these co-owned applications is also herein incorporated by reference in their entirety.

SUMMARY

In one aspect, the invention is a display system that includes a display, a backlight providing illumination for said display, a backlight control module for providing backlight control signals to said backlight, and an adaptive transition rate module. The adaptive transition rate module calculates an adaptive parameter based on a magnitude of change between backlight requirements for two frames, determines a smoothing function based on the adaptive parameter, and uses said smoothing function to modify said backlight control signals.

In another aspect, the invention is a method for adaptively changing backlight illumination. The method entails gathering backlight statistics on a first and second frames of image, and comparing the two statistics to determine an adaptive transition rate and a smoothing function. The adaptive transition rate is applied to the smoothing function, and the backlight illumination level is adjusted based upon the application of the smoothing function to the image data.

DETAILED DESCRIPTION

Figure 1:
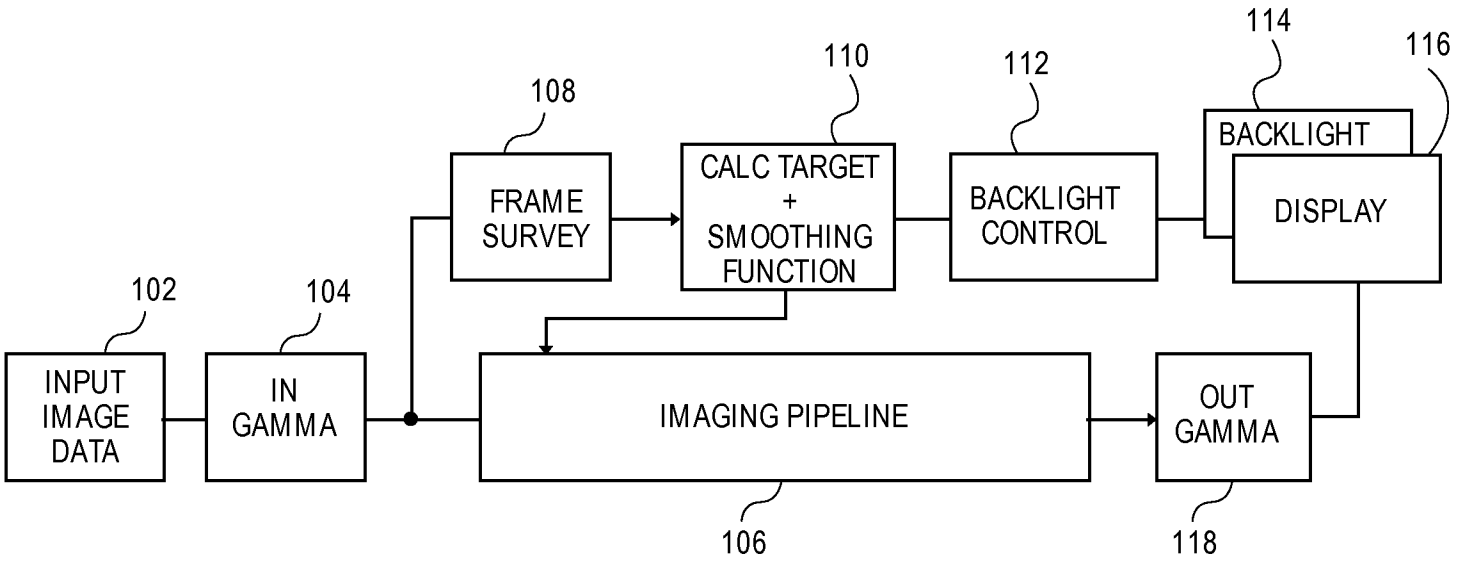
FIG. 1 shows one embodiment of a display system that comprises one or more of the modules and techniques of the present invention.

Many display panel systems utilize some form of Dynamic Backlight Control (DBLC) function. This function allows for control over power usage and image quality. Along with the ability to change the backlight level comes the critical need to adjust it and other display parameters intelligently to avoid causing bothersome artifacts to image quality.

For merely one paradigm example, changing the backlight frame by frame often presents the problem of "flicker." To address this problem, it is common to employ some form of dampening function to smooth out backlight changes and make them less noticeable. In many prior art systems in which a relatively fast LED backlight is coupled to a relatively slow responding LCD front panel, such dampening functions are typically designed to dampen the changes of the backlight illumination because of the relative response differential between the backlight and the LCD front panel.

As used herein, "smoothing" broadly refers to a general reduction in the rate of change, including but not limited to the rate of change as a function of time or space. "Dampening" refers to a reduction in the rate of change as a function of time, and is a specific type of "smoothing." "Display parameters" broadly refers to values for providing optimal backlight to a frame N, including but not limited to optimal backlight values, target gamma transfer characteristic parameters, and parameters for controlling gamut mapping, scaling, and subpixel rendering. "Statistics" on a frame, as used herein, refers primarily to frame-wide statistics for a value that may vary pixel to pixel, such as statistics relating to optimal backlight requirement for each pixel in the frame wherein the optimal backlight requirement is calculated using image data. Statistics on a frame may include but is not limited to the maximum image data in a frame (e.g., the highest of R, G, B, and if available, W values), average image data in a frame, or a minimum image data in a frame and how many pixels have or exceed the selected image data values.

A mismatch of color and luminance between an image and a modified one is another reason why dampening functions are employed. Typically for a DBLC system, the backlight value is determined based on the image content of a given frame. Simplistically, for dark images, the backlight level may be lower, and for bright images the backlight level may be higher. Then the inverse of the backlight level is applied to the LCD shutter values to compensate for the varying backlight and give a resulting image that is the same as the original. Generally, the LCD values and backlight values can be coarsely balanced such that the final image is similar to the original one, however, in practice, it is very difficult to match the original perfectly for a wide range of pixel color and luminance in a given frame. The difference between original and modified images results in flicker when a series is shown over time without dampening.

In many instances, however, it may not be desirable to dampen the response of the backlight and, in fact, dampening may create visual artifacts that might be noticeable and undesirable. For example, when an image changes suddenly or drastically, over-dampening may cause a slow fade-in response, in which case no or minimal dampening would be optimal. To accommodate both fast and slow-changing image sequences, a method for intelligently adjusting the degree of dampening may be desirable.

FIG. 1 shows one embodiment of a display system in which the techniques of the present application may be applied. Interface 102 to the display system could be employed to input image data or generate such image data. Optional input gamma block 104 could be employed in the display system, particularly if the display is of technology that needs to adjust for gamma—e.g. LCD displays. Image data may take two paths—one for control of the backlight and one for control of the display. Frame survey 108 may gather certain image data statistics on a frame to determine whether a present frame (or portion thereof) is part of a same or similar scene or represents a change in scenes that might require a large change in the backlight illumination.

Calc target and smoothing function block 110 could be employed to determine a target backlight illumination for the given frame (or portion thereof) and determine a smoothing function (from perhaps a set of suitable functions) to change the illumination of the backlight from a previous value to the target value in such a way as to minimize visual artifacts. Backlight illumination signals from block 110 are then employed by backlight control 112 that, in turn, may drive backlight 114. It should be appreciated that backlight 114 may be any one of many different types of backlights available—.e.g. LED backlights, CCFL backlights or the like. The backlight could also be constructed in any known configuration—e.g. a 2-D array of individual emitters or a set of edge lit emitters or any other known configuration.

Image data may also be processed in an imaging pipeline 106 which could include any number of optional blocks and functions—for example, if the input image data is described in one gamut space and the display represents a different gamut space (e.g. such as RGB data to be rendered on a RGBW or other multiprimary display), then an optional gamut mapping algorithm (GMA) may be employed. Likewise, if the data is to be subpixel rendered onto the display, then block 106 may comprise an optional subpixel rendering processing (SPR) block. Such may be the case if the display comprises any one of a novel subpixel repeating group, as is detailed in many of the patent applications described above. Finally, image data may be processed in an optional output gamma block 118 before the signals are sent to display 116—e.g. to drive individual subpixels upon display 116.

Figure 2:
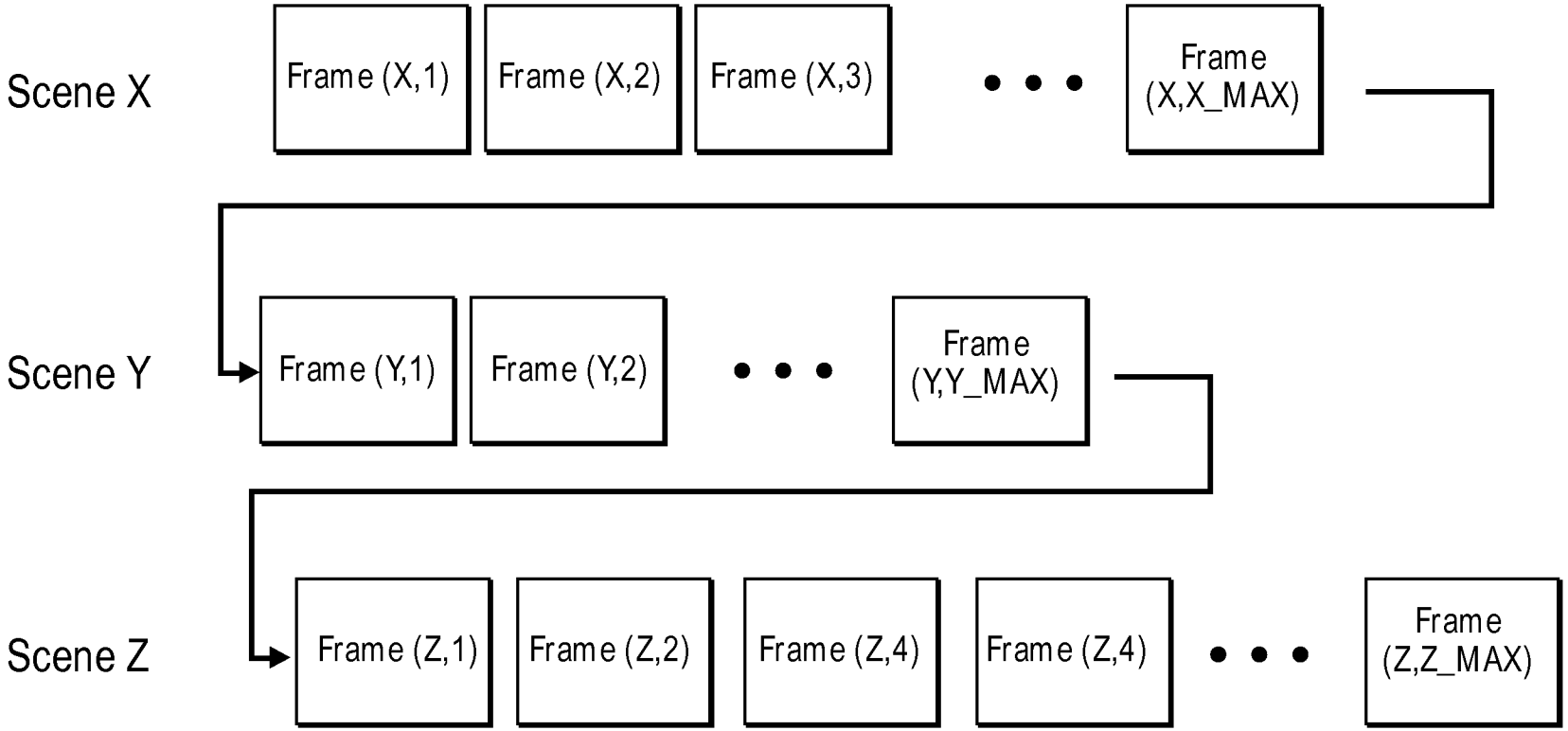
FIG. 2 depicts an example of three scenes, each scene comprised of substantially similar image data.

FIG. 2 depicts an example of three "scenes" being displayed by a display system. For purposes of the present discussion, a "scene" is a set of highly-correlated frames of image data that comprise the scene. By way of mere example, one scene might be low light images filmed in the hold of a submarine; while another scene might be the bright open-light images of the submarine command on the deck of the surfaced submarine. As seen in FIG. 2, scene X may comprise of Frames (X,1) through Frame (X, X_Max). These frames themselves will likely vary in terms of image data and the illumination needed to faithfully render the frames on the display. The frame immediately following Frame (X, X_Max) starts Frame (Y, 1)—the first frame of scene Y. Similarly, this situation holds for scene Z and its comprising frames.

Figure 3:
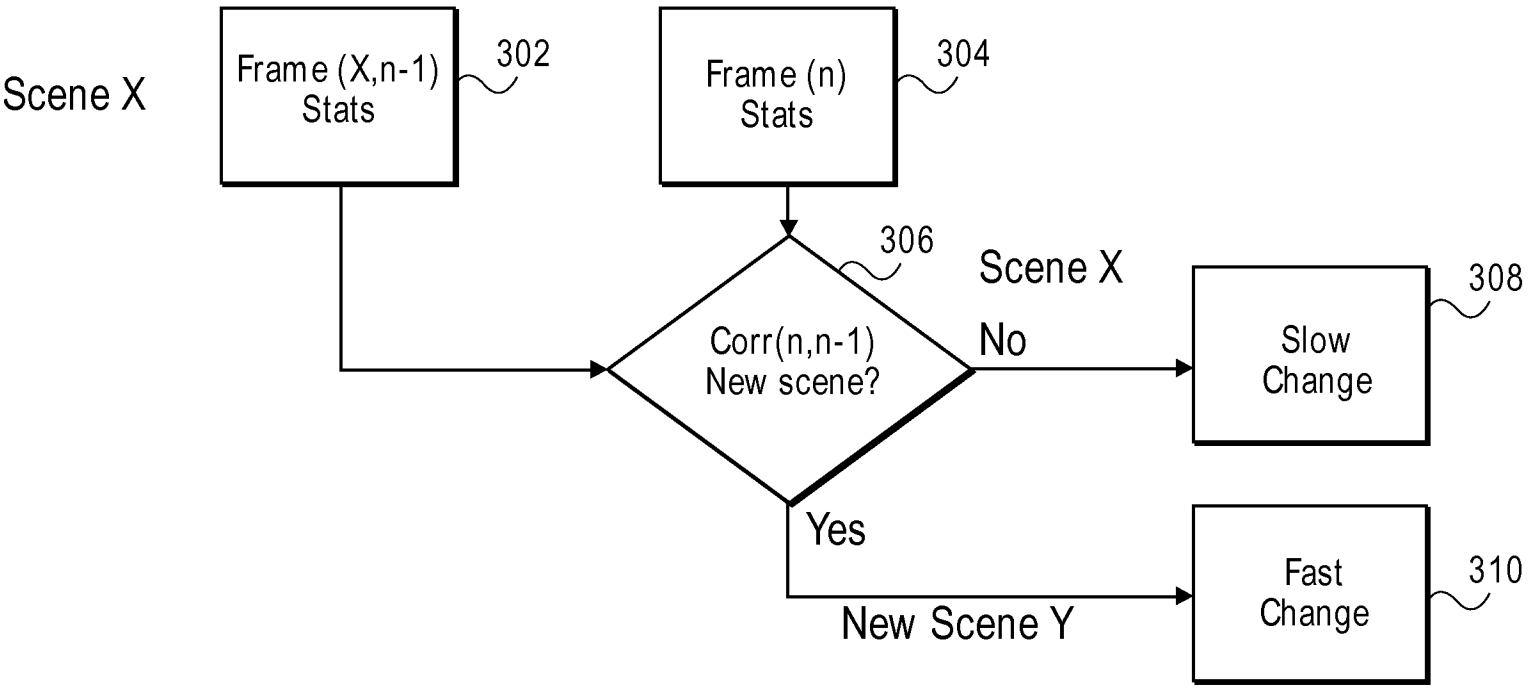
FIG. 3 depicts one embodiment of a technique for adaptively changing backlight illumination based on whether current image data remains as a part of a current scene or whether it is a part of a new scene.

The display system establishes conditions for when a new scene is being rendered and is able to detect such conditions. FIG. 3 depicts one embodiment of just such a technique and system. Frame 302 represents the statistics gathered for a previous frame (or portion thereof). In this example, frame 302 is Frame (X, n-1) from scene X and the current frame 304 has compiled comparative statistics regarding its image data and a comparison is made at a correlation module 306 to determine if frame 304 is a continuation of scene X or represents the first frame of a new scene.

Figure 4A:
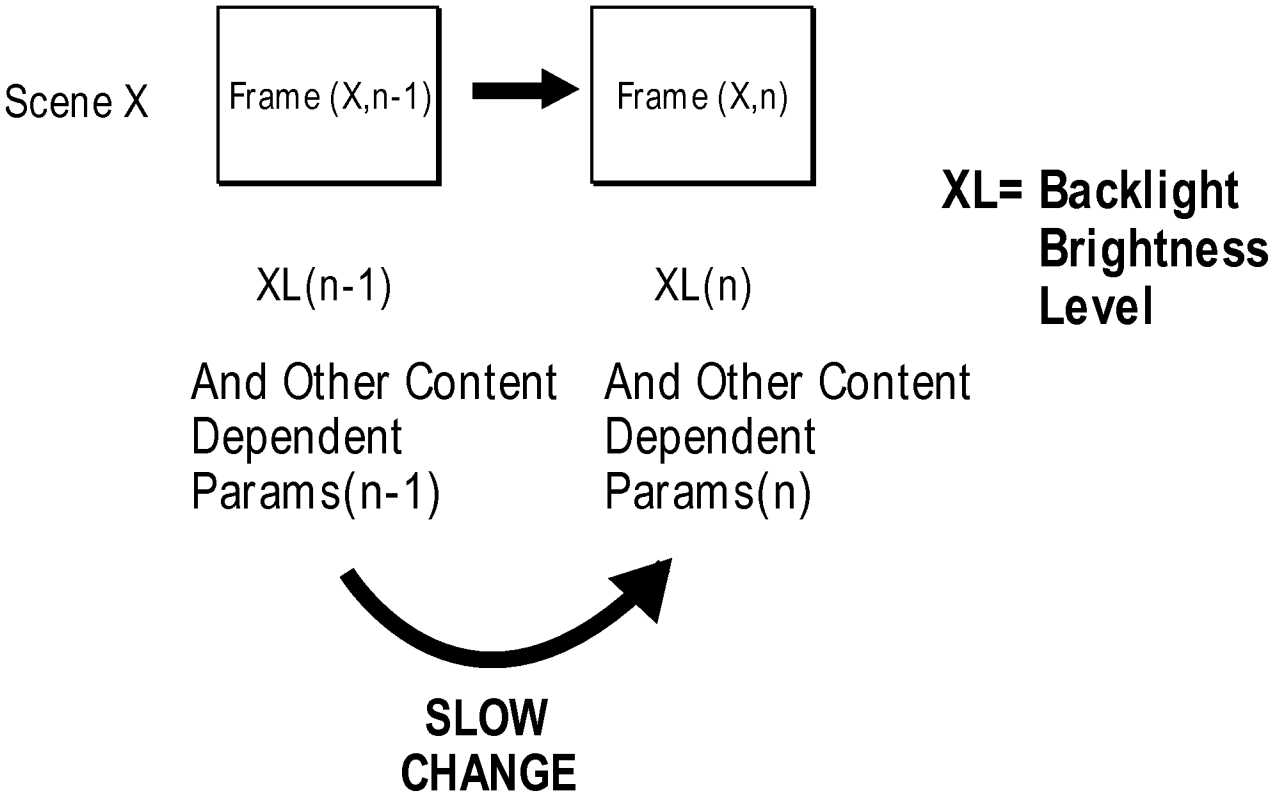
FIGS. 4A and 4B depict how the backlight would be treated under the two scenarios depicted in the embodiment of FIG. 3.
Figure 4B:
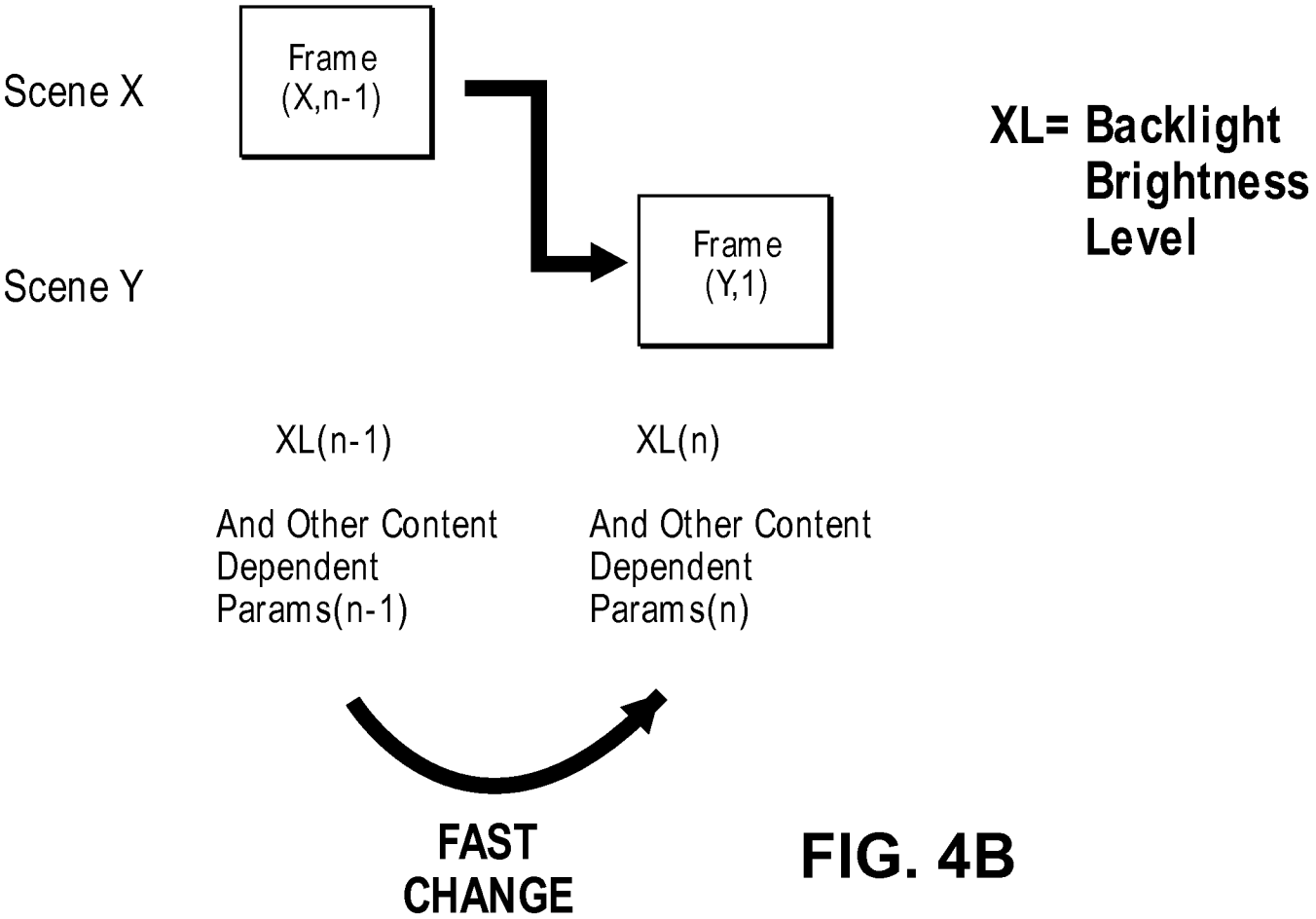

In one embodiment of the present application, if it is determined that the frame 304 is a part of scene X, then the present embodiment would proceed with a slow change 308 of the backlight illumination and corresponding parameters to avoid flicker. Otherwise, frame 304 is the first frame of a new scene and the present embodiment would proceed with a fast change 310 of the backlight illumination and corresponding parameters. This treatment by the present embodiment is additionally shown in FIGS. 4A and 4B, respectively. Depending on the rate of change that is needed between two frames, an adaptive parameter is determined. Using the adaptive parameter, a smoothing function that uses the adaptive parameter to represent the actual rate of change between the two frames is determined.

Figure 5A:
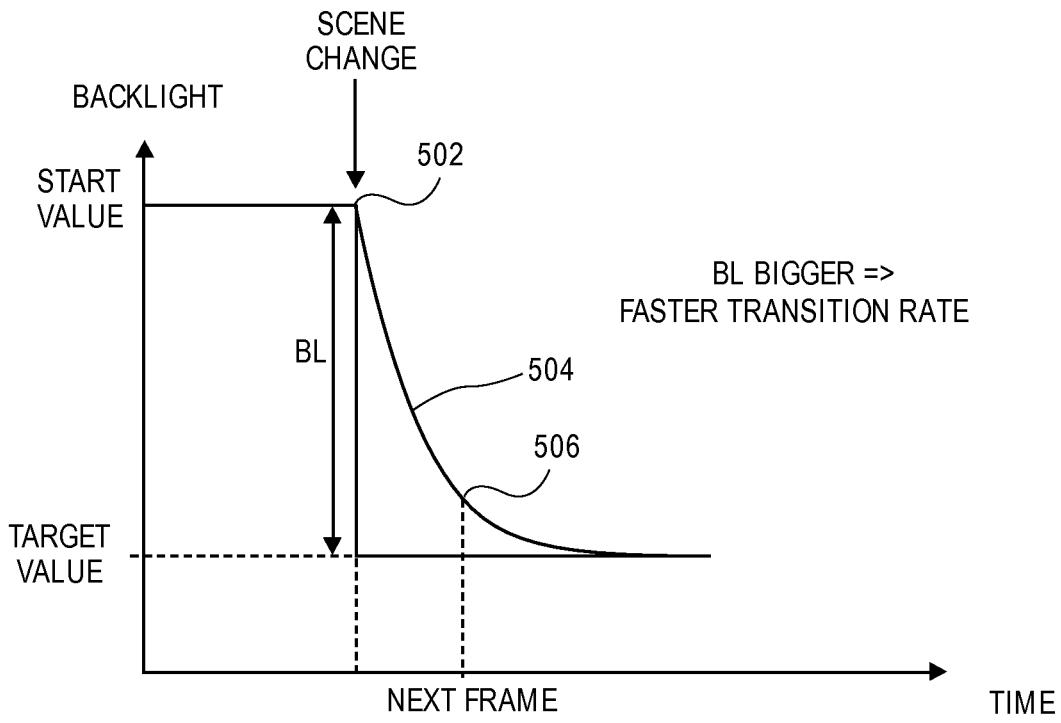
FIGS. 5A and 5B represent exemplary response curves for backlight illumination versus time for scene changes and same scene frames respectively.
Figure 5B:
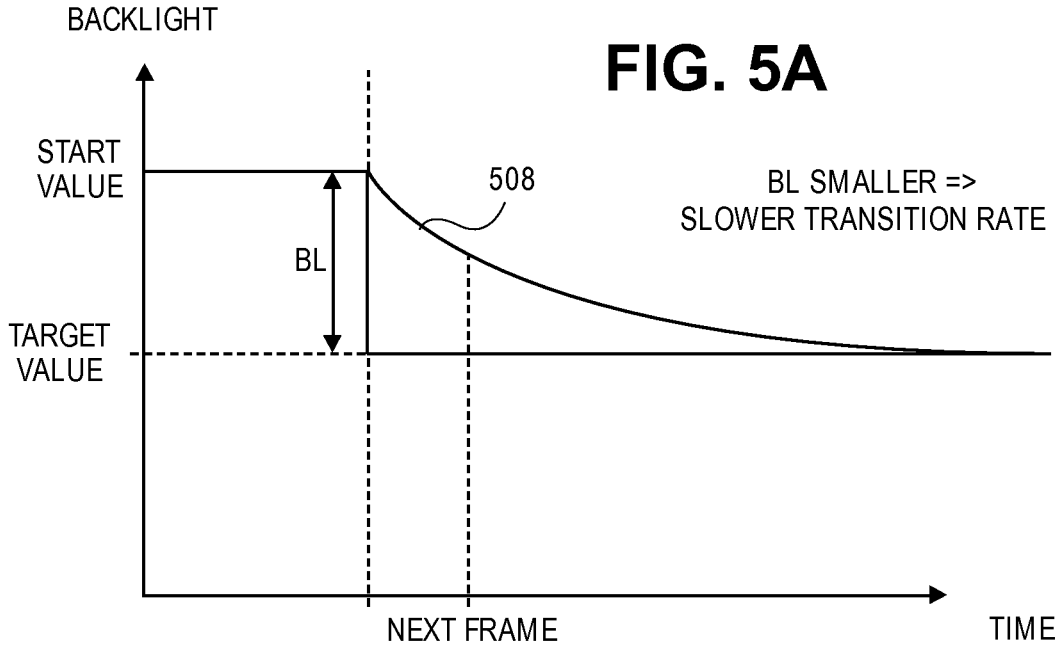

FIGS. 5A and 5B represent exemplary response curves for backlight illumination versus time for scene changes and same scene frames respectively. In FIG. 5A, the backlight starts out with a relatively stable illumination until point 502 when a scene change is determined to happen. The backlight should be commanded to move from the Start Value illumination to Target Value illumination over time. Curve 504 is selected as a fast transitioning curve, and the value of illumination at Next Frame will be determined by this curve at 506.

By contrast, FIG. 5B depicts a change in backlight illumination from Start Value illumination to Target Value illumination with a much less delta BL as required in FIG. 5A. In this case, it is likely that the next frame is part of the same scene as before and so, a more gradual transition curve 508 is used so that when the next frame is set to be rendered, the backlight has not experienced a dramatic change in illumination. This gradual change would tend to reduce the amount of noticeable flicker between image frames that are ostensibly correlated to a same scene.

Figure 5C:
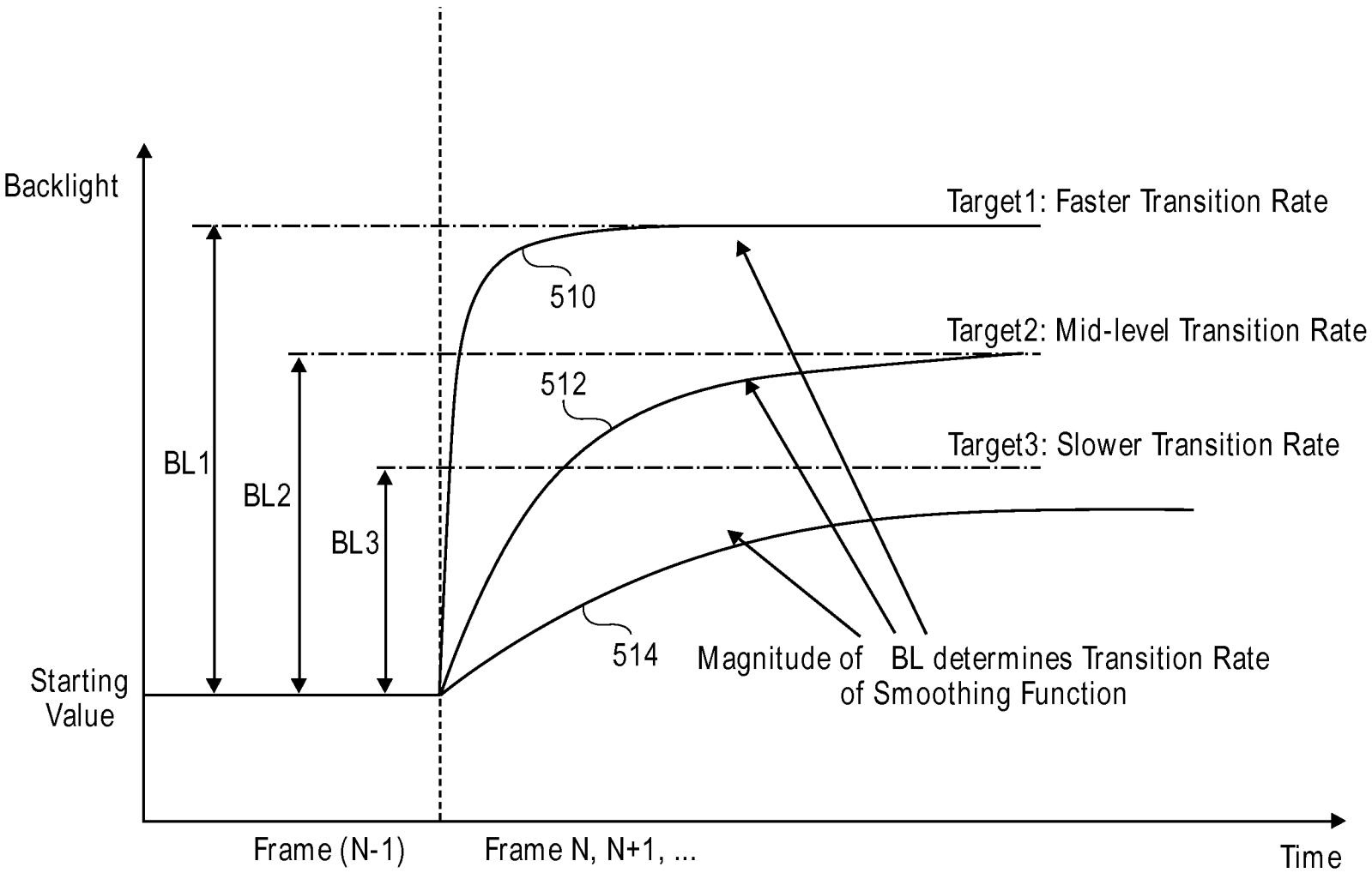
FIG. 5C depicts a family of response curves which may be selected depending upon the backlight delta commanded.

FIG. 5C depicts a similar scenario as FIGS. 5A and 5B except that the illumination to the next frame is requiring greater illumination than the frame before it. The present embodiments may include a family of response curves (as depicted by exemplary curves 510, 512 and 514 and possible others). The choice of response curve might again be chosen depending upon whether the next frame comprises a continuation of a scene or the first frame of a new scene or something in between. This figure also suggests that a backlight Delta may be used to determine which response curve is chosen.

Figure 5D:
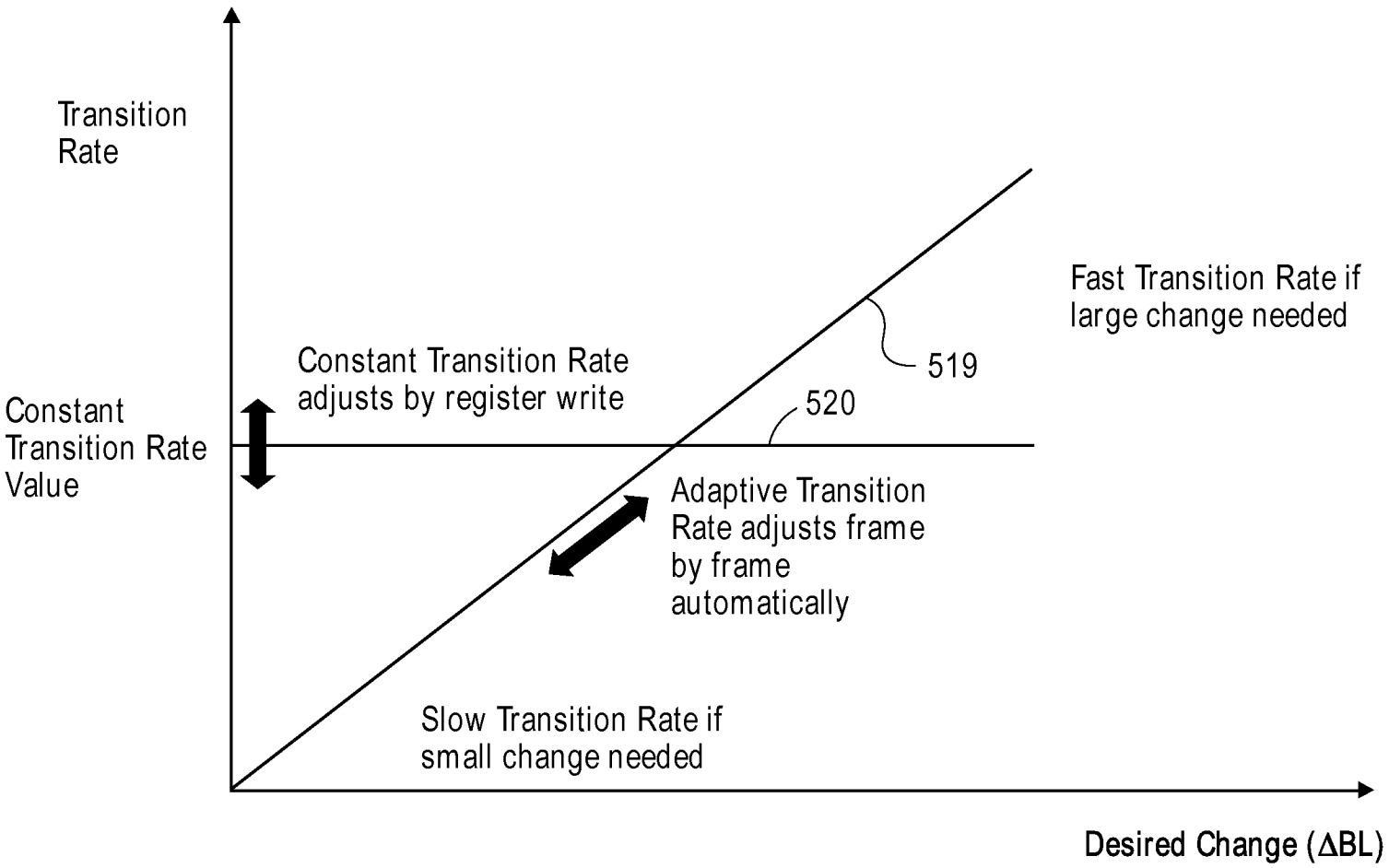
FIG. 5D depicts a mapping of transition rates versus desired changes in backlight illumination for both constant transition rate techniques and adaptive transition rate techniques.

FIG. 5D depicts a mapping of transition rates versus the desired change in backlight illumination (delta BL). Constant line 520 depicts what happens in typical dampening schemes that do not consider whether a scene change has been made or not—i.e. a constant transition rate is selected and maintained until a signal is received to trigger a change, perhaps from a register write. Of course, this constant transition rate may, in some cases, have two values—depending on whether the signaled change in backlight is for an increase or decrease in illumination. By contrast, curve 519 depicts that the transition rate of the backlight is adaptive, depending upon the amount of change in the backlight illumination and/or whether there is a change in scene. It will be appreciated that although curve 519 is depicted as a sloped straight line, other curve shapes are contemplated by the present application.

Figure 5E:
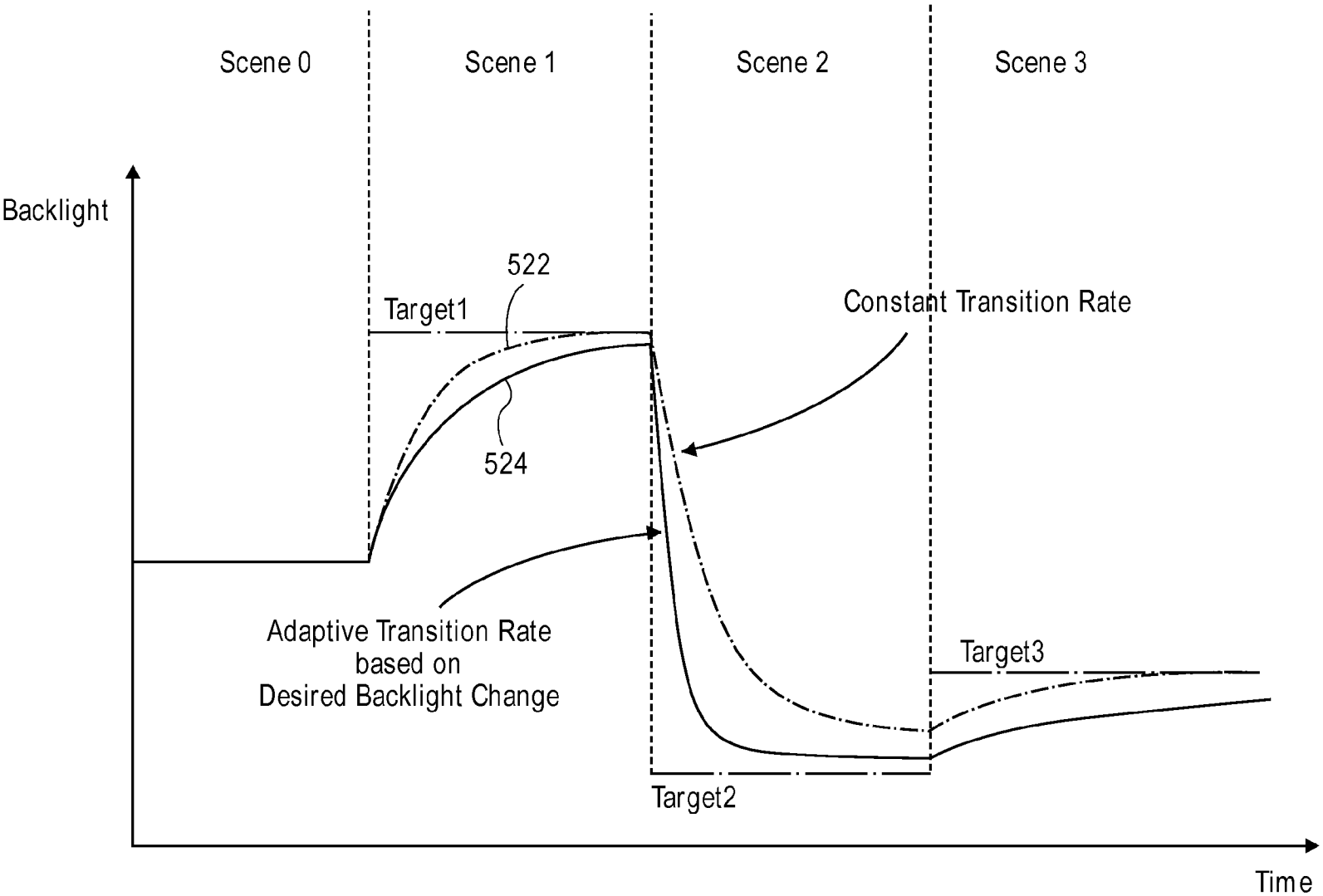
FIG. 5E depicts one example comparing the performance of constant rate transition curves versus adaptive rate transitions curves over a exemplary set of scene changes.

Other adaptive choices are possible under the present set of techniques. FIG. 5E shows exemplary curves of backlight illumination over time with a putative set of scenes 0, 1, 2 and 3 occurring over time. In these cases, the dampening function may be substantially an exponential decay, as may be typically expressed in the form of $e^{-time/tau}$ for some value "tau" (tau would be the adaptive parameter in this case). Dashed and dotted curve 522 depicts a display system in which tau is selected as a constant. By comparison, curve 524 is an exponential curve in which the value of tau is adaptive depending upon the amount of signaled change in the backlight illumination.

In some cases—e.g. in going from scene 0 to scene 1—the constant curve may converge to the Target 1 illumination value faster than that of the adaptive curve (possibly because the change from scene 0 illumination to Target 1 illumination is considered small by the adaptive choice of tau. However, where there are larger changes in backlight illumination—e.g. from Target 1 illumination to Target 2 illumination, the adaptive scheme could select a tau in which convergence to Target 2 is faster for the adaptive curve than for the constant tau curve. Since the magnitude of change between Scene 0 to Scene 1 is different from the magnitude of change between Scene 1 to Scene 2 and between Scene 2 and Scene 3, the adaptive parameters that reflect the magnitude of change between each of these scenes would be different. More specifically, based on the relative magnitudes of the changes, the adaptive parameter for the transition from Scene 0 to Scene 1 would be some type of a medium value while the adaptive parameter for the transition from Scene 1 to Scene 2 would be a high value and the adaptive parameter for the transition from Scene 2 to Scene 3 would be a low value. Using the adaptive backlight control method of the invention, smoothing functions would be determined for the three transitions based on the three adaptive parameters, and applied to reach the Target at the optimal rate. Smoothing functions for two consecutive frame-to-frame transitions may be the same or different.

It will be appreciated that although FIG. 5E depicts exponential decay curves, any other decay curve (e.g. linear or the like) is possible. It suffices that a different rate of convergence towards the new target illumination is adaptively selected depending upon the change in backlight illumination that is signaled. For example, the smoothing functions could be a set of linear curves and the adaptive parameter may be the slope (varying proportionally to the absolute difference of two different backlight illumination commands) for said linear function.

Figure 5F:
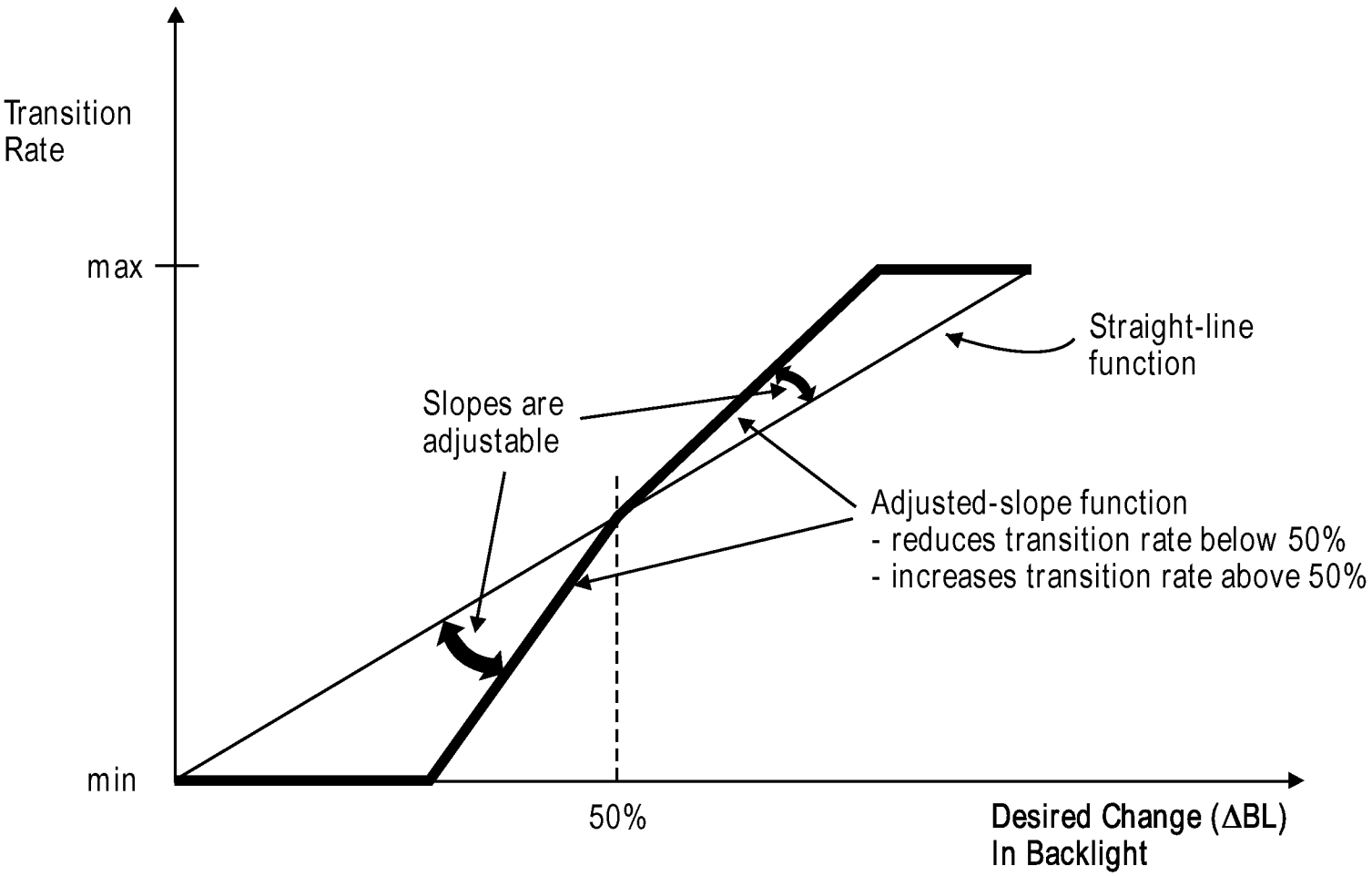
FIG. 5F depicts another mapping of transition rate versus desired change in backlight illumination.

FIG. 5F depicts another mapping of transition rate versus desired change in backlight illumination. Compared to FIG. 5D, change can be made even slower when differences in backlight level that are less than 50% of the range, already resulting in slow transition rates. Register controls can effectively reduce the low-end slope of the plot of FIG. 5F, and the upper-end of the range can have a higher slope or remain unchanged.

Figure 6:
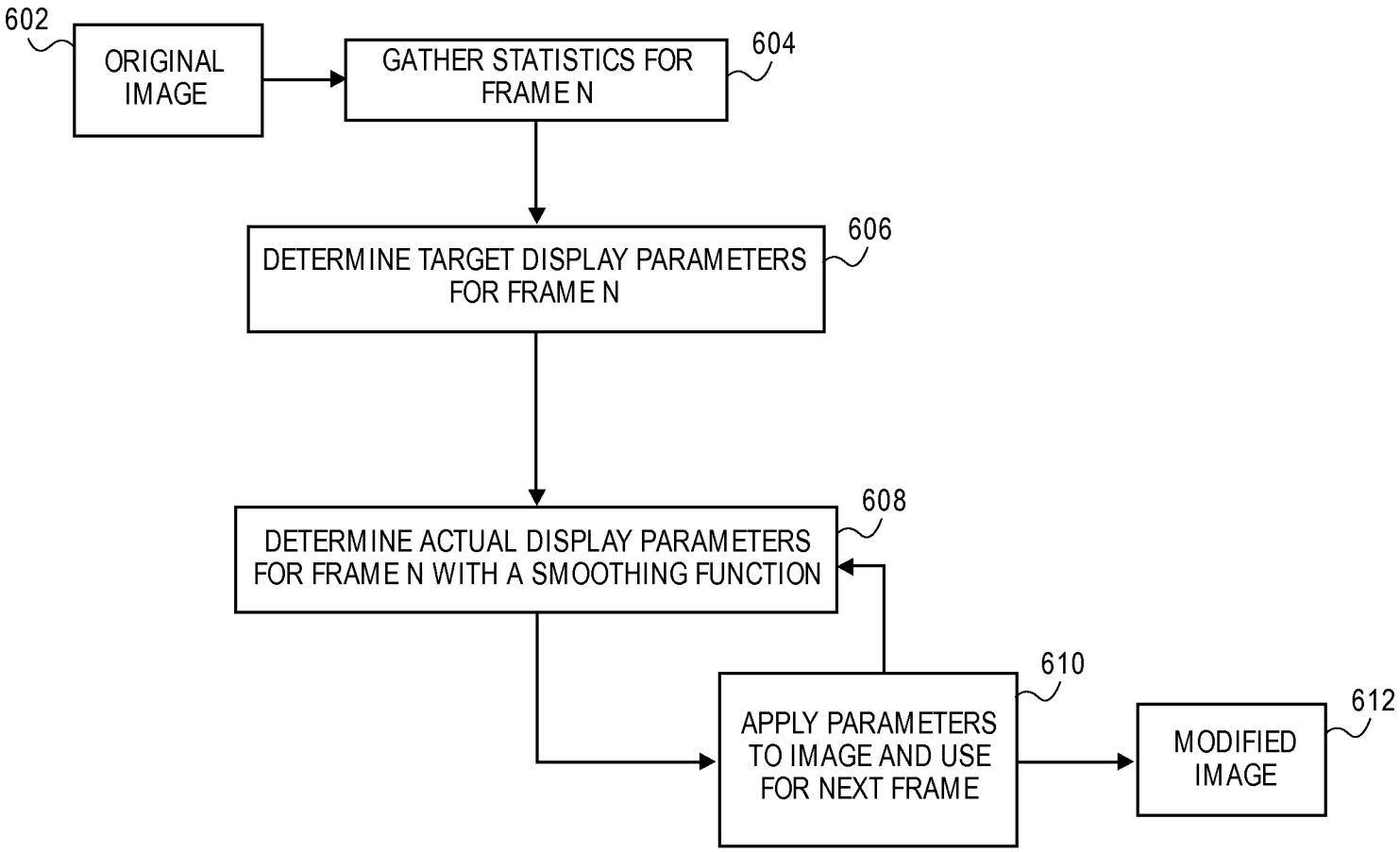
FIG. 6 depicts one embodiment of a module and technique in which an original image is presented and statistics for frame N are gathered.

FIG. 6 depicts one embodiment of a module and technique in which an original image 602 is presented and statistics for frame N are gathered in block 604. Target display parameters for frame N are determined in block 606. From these parameters, actual display parameters are determined using a smoothing function at block 608. These parameters are then applied and used for next frame processing at block 610. The modified image is then presented at block 612 for rendering by the display system. This embodiment does not use an adaptive parameter that allows "customization" for each frame transition.

Figure 7:
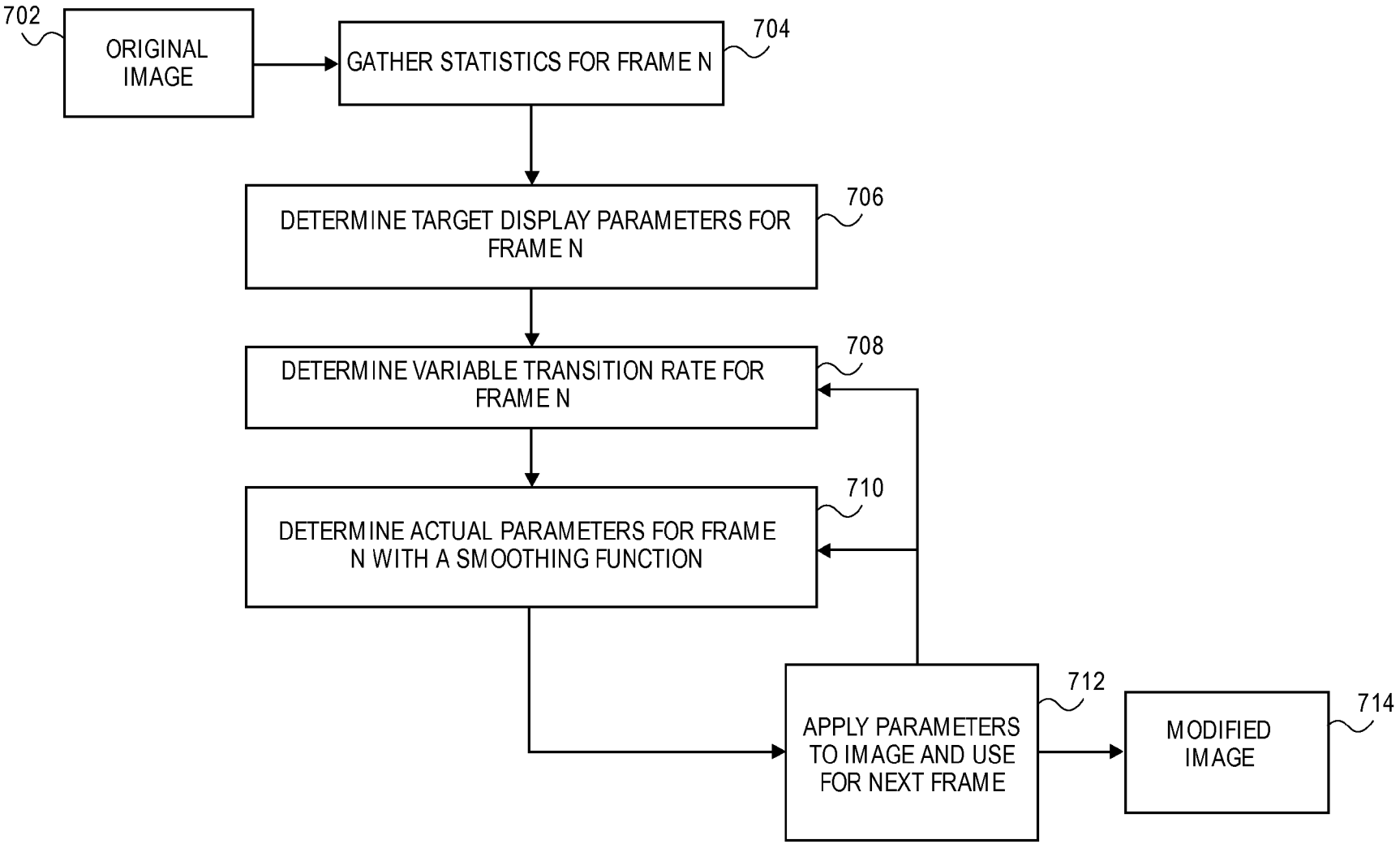
FIG. 7 depicts another embodiment for modifying an original image for display where a transition rate is variably determined in accordance with the invention.

FIG. 7 depicts an embodiment of the invention for modifying an original image for display where a transition rate is variably determined. Original image is presented at block 702 and statistics are gathered for frame N at block 704. Target display parameters for frame N are determined at block 706 and a variable transition rate (i.e., the adaptive parameter) is selected for frame N at block 708. Actual parameters are determined at block 710 by using a smoothing function (which includes the adaptive parameter) and applied to image and used for next frame at block 712. Thereafter, the modified image is presented at block 714.

Figure 8:
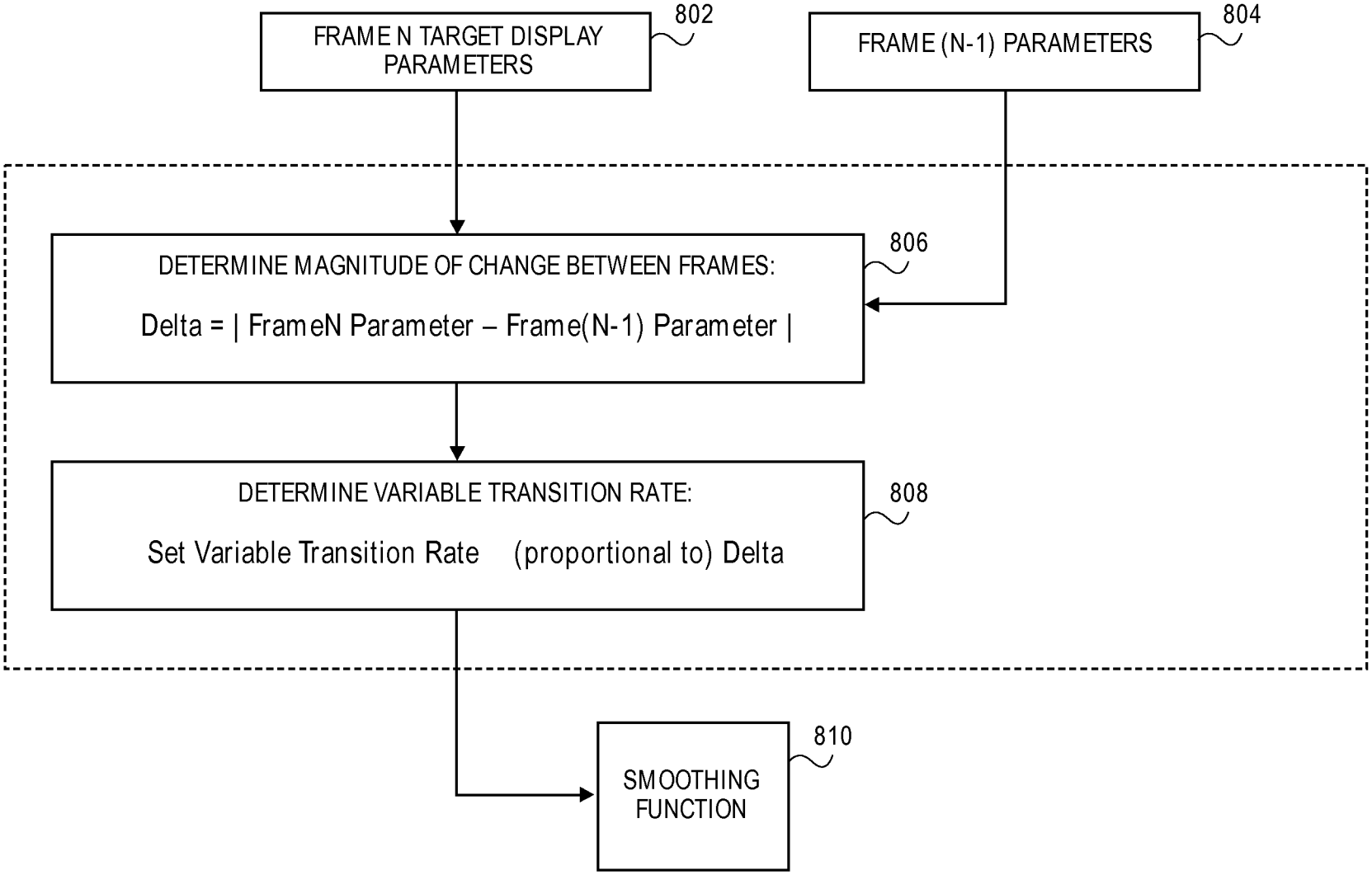
FIG. 8 depicts an embodiment for determining a suitable smoothing function.

FIG. 8 depicts an embodiment for determining a suitable smoothing function. Frame N target display parameters 802 and N-1 parameters 804 are used to determine the magnitude of the change of parameters (e.g. requested backlight illumination) at block 806. From this determination, the variable transition rate may be set proportional (or otherwise functionally related) to the delta parameter change in block 808. From this, the smoothing function is presented at block 810.

One possible pseudo-code implementation of some of the techniques are given in Table 1 as follows:

TABLE 1

```
BL1[8:0] = Backlight value of previous frame (9 bits)
BL2[8:0] = Target backlight value of new frame based
on image contents (9 bits)
Delta_BL[8:0] = difference between BL1 and BL2 (still 9 bits):
If BL1 > BL2,
    Delta_BL = BL1 − BL2
    Else
      Delta_BL = BL2 − BL1
Decay Rate[5:0] = Delta_BL[8:3]
```

In this particular implementation the Decay Rate value may be 6 bits, ranging from 0 to 63. If it is set to 63, the transition will be very fast, and if set to 0 it will be very slow. To make the Decay Rate proportionally adaptive, set Decay Rate to Delta_BL, normalized to the range of Decay Rate, which turns out to be the 6 most significant bits of Delta_BL. The Decay Rate may also be adaptive non-proportionally if a non-linear relationship is applied.

This dynamically-generated Decay Rate can then be used in a smoothing function to determine the actual Backlight Value and corresponding parameters to be used for the frame. This new Backlight Value then becomes BL1 for the next frame's calculations.

A software implementation of the Decay Rate calculation and smoothing function may not be as limited in bit-depth compared to the hardware calculation. Thus, curves can more closely match the logarithmic curves discussed. However, due to hardware limitations of logic size and bit-depth, a hardware approximation may be designed to decay more slowly and smoothly toward the desired target. In order to allow the instantaneous slope of the curve to approach zero asymptotically, without adding more bit depth, a hold counter is used to hold backlight values for multiple frames before allowing it to move another step toward the target. Holding the backlight and delaying its change will effectively create a shallower, more asymptotic approach.

A conceptual logical flow follows:

Big change in image→needs big change in backlight→big Delta_BL→big Transition Rate→Fast transition Small change in image→needs small change in backlight→small Delta_BL→small Transition Rate→Slow transition When the above-described method is applied, changes in backlight are dampened when needed and also quick when desired. The end result may be a great reduction of flicker for videos while quick transitions are maintained for slide shows and sudden image changes.

It should be understood that the invention can be practiced with modification and alteration within the spirit and scope of the appended claims. For example, although the invention is herein described in the context of backlight illumination, the adaptive smoothing method described above may be used for any parameter that is desirous of frame-to-frame adaptation. The description is not intended to be exhaustive or to limit the invention to the precise form disclosed.

What is claimed is:

1. A display system comprising:

a display;

a backlight providing illumination for the display;

a backlight control module for providing backlight control signals to the backlight; and an adaptive transition rate module, the adaptive transition rate module determining transition rates based on a magnitude of change between backlight requirements for two frames, wherein the transition rate has a first transition rate when the magnitude of change between backlight requirements for two frames is higher than a predetermined value and a second transition rate when the magnitude of change between backlight requirements for two frames is lower than the predetermined value, and wherein the first transition rate is higher than the second transition rate.

2. The display system as recited in claim 1 wherein the adaptive transition rate module includes a smoothing function block which determines smoothing function depend on the magnitude of change between backlight requirements for two frames.

3. The display system as recited in claim 2 wherein the smoothing function is substantially a logarithmic function of time, and the adaptive parameter is an adaptive time constant for the logarithmic function.

4. The display system as recited in claim 2 wherein the smoothing function is substantially a linear function of time, and the adaptive parameter is an adaptive slope for the linear function.

5. The display system as recited in claim 4, wherein the adaptive slope is decreased when a difference in back light levels is less than 50% of a range of maximum transition rate.

6. The display system as recited in claim 5, wherein the adaptive slope is increased when a difference in back light levels is more than 50% of a range of maximum transition rate.

7. A method for adaptively changing backlight illumination, the method comprising:

gathering statistics on a first frame of image data;

gathering statistics on a second frame of image data; and determining a transition rate based on a magnitude of change between backlight requirements for two frames, wherein the transition rate has a first transition rate when the magnitude of change between backlight requirements for two frames is higher than a predetermined value and a second transition rate when the magnitude of change between backlight requirements for two frames is lower than the predetermined value, and wherein the first transition rate is higher than the second transition rate.

8. The method as recited in claim 7 wherein the determining a transition rate comprises:

determining magnitude of change between backlight requirements for two frames, determining variable transition rate based on the magnitude of change between backlight requirements for two frames, and determining a smoothing function based on the variable transition rate.

9. The method as recited in claim 8, wherein the variable transition rate is proportional to the a magnitude of change between backlight requirements for two frames.

10. The method as recited in claim 9, wherein the variable transition rate is proportional to the magnitude of change between backlight requirements for two frames.

11. The method as recited in claim 10, wherein the variable transition rate is decreased when a difference in back light levels is less than 50% of a range of maximum transition rate.

12. The method as recited in claim 10, wherein the variable transition rate is increased when a difference in back light levels is more than 50% of a range of maximum transition rate.

* * * * *